US005188127A

United States Patent [19]

Heitmann

[11] Patent Number: 5,188,127

[45] Date of Patent: Feb. 23, 1993

[54] APPARATUS FOR FEEDING TOBACCO TO DISTRIBUTORS OF ROD MAKING MACHINES

[75] Inventor: Uwe Heitmann, Hamburg, Fed. Rep. of Germany

[73] Assignee: Körber AG, Hamburg, Fed. Rep. of Germany

[21] Appl. No.: 745,521

[22] Filed: Aug. 15, 1991

[30] Foreign Application Priority Data

Aug. 30, 1990 [DE] Fed. Rep. of Germany ..... 4027409

[51] Int. Cl.[5] ..... A24C 5/18; A24C 5/39

[52] U.S. Cl. ..... 131/108; 131/110; 131/84.3

[58] Field of Search ..... 131/108, 110, 84.1, 131/84.3

[56] References Cited

U.S. PATENT DOCUMENTS 4,185,644 1/1980 Heitmann ..... 131/109 R
4,401,205 8/1983 Komossa ..... 198/524
4,610,260 9/1986 Heitmann ..... 131/110 X
4,651,758 3/1987 Kahrau ..... 131/109.2
5,009,238 4/1991 Heitmann ..... 131/110 X
5,072,742 12/1991 Heitmann ..... 131/110 X

*Primary Examiner*—V. Millin
*Assistant Examiner*—J. Doyle
*Attorney, Agent, or Firm*—Peter K. Kontler

[57] ABSTRACT

Apparatus for feeding batches or a continuous stream of tobacco particles into the magazine of the distributor in a cigarette or cigar rod making machine has a container which can receive a stream of gaseous carrier medium for tobacco particles from a shredding machine or from another source and has several outlets for the carrier medium. The outlets discharge the carrier medium in different directions and contain sieves which intercept the tobacco particles. The thus accumulated particles can descend into the magazine, either continuously or at intervals, depending upon whether or not the tobacco discharging opening of the container is temporarily closed by a pivotable or otherwise movable closure.

10 Claims, 2 Drawing Sheets

APPARATUS FOR FEEDING TOBACCO TO DISTRIBUTORS OF ROD MAKING MACHINES

BACKGROUND OF THE INVENTION

The invention relates to tobacco feeding or supplying apparatus in general, and more particularly to improvements in apparatus which can be utilized with advantage for delivery of tobacco to the distributors (also called hoppers) of rod making machines, such as cigarette, cigarillo or cigar rod making machines. Still more particularly, the invention relates to improvements in apparatus which can segregate particles of tobacco (particularly shredded tobacco ribs and/or shredded tobacco leaf laminae) from a gaseous carrier medium preparatory to dumping or another mode of delivering separated tobacco particles into the magazine of the distributor in a rod making machine.

It is already known to install the magazine of a distributor in a cigarette rod making machine beneath a container which is connected to the discharge end of a pneumatic conveyor and has an opening for admission of tobacco particles into the magazine. The particles of tobacco are delivered by a stream of gaseous carrier medium (such as air), and the container has an outlet for evacuation of the gaseous carrier medium. The outlet contains a filter, a screen or a sieve which intercepts the particles of tobacco. The arrangement is such that, when a sensor detects that the upper surface of the tobacco supply in the magazine has descended to a predetermined level, a signal from the detector initiates the flow of a stream of gaseous carrier medium which entrains tobacco particles from a main source of supply. As a rule, the stream of gaseous carrier medium is drawn into the container by suction in a second pneumatic conveyor which receives gaseous carrier medium from the outlet of the container. A detector monitors the quantity of intercepted tobacco particles in the container and transmits a signal when such quantity reaches a preselected value; the signal is used to expose the opening of the container in order to permit the transfer of accumulated tobacco particles from the container into the magazine of the distributor. The opening is thereupon closed and the container is ready to accumulate a fresh batch of tobacco particles.

It is also known to design the apparatus for delivery of tobacco particles to the magazine of a distributor in such a way that the magazine receives an uninterrupted flow of tobacco particles, i.e., that the supply of particles in the magazine is replenished at the rate at which a conveyor draws tobacco from the magazine to form a stream which is thereupon converted into a rod-like filler ready to be wrapped into a web of cigarette paper or other suitable wrapping material.

OBJECTS OF THE INVENTION

An object of the invention is to provide an apparatus which can be utilized for delivery of tobacco particles to the distributor of a rod making machine in such a way that the particles of tobacco which enter the container with a stream of gaseous carrier medium are less likely to prevent or to interfere with controlled outflow of carrier medium from the container than in heretofore known apparatus.

Another object of the invention is to provide a novel and improved container for use in the above outlined apparatus.

A further object of the invention is to provide the apparatus with novel and improved means for collecting the gaseous carrier medium which is evacuated from the container.

An additional object of the invention is to provide a novel and improved method of segregating particles of tobacco from a gaseous carrier medium between a main source of tobacco particles and the magazine of the distributor in a rod making machine.

Still another object of the invention is to provide a rod making machine which embodies the above outlined apparatus.

SUMMARY OF THE INVENTION

The invention is embodied in an apparatus for separating tobacco (for example, shredded tobacco) from at least one stream of air or another gaseous carrier medium. The improved apparatus comprises a container (e.g., a sluice) having an inlet for admission of the at least one stream and of the tobacco in the stream, at least one outlet for evacuation of gaseous carrier medium from the container in a plurality of preferably different directions, and gas-permeable tobacco intercepting means (e.g., one or more flat, curved and/or otherwise configurated screens, filters or sieves) in the at least one outlet.

The apparatus further comprises a pneumatic conveyor for the at least one stream of gaseous carrier medium; such conveyor has a discharge end which is connected to the inlet of the container.

In accordance with a presently preferred embodiment, the container has a polygonal cross-sectional outline with at least three sides (such sides are inclined relative to each other). The at least one outlet can have portions in at least two sides of the polygonal container, and the latter is further provided with at least one tobacco evacuating opening in another of its sides.

As mentioned above, the intercepting means can comprise one or more screens, filters or sieves, e.g., a discrete sieve at each of the at least two sides of the polygonal container. The container can have four sides and the outlet can have portions in three sides of such quadrangular container. The side which is provided with the aforementioned at least one opening is or can be located beneath the outlet.

The apparatus can further comprise a gas collecting device defining at least one gas confining space which is outwardly adjacent the at least one outlet of the container to receive gaseous carrier medium which penetrates through the intercepting means, and a second pneumatic conveyor which evacuates gaseous carrier medium from the at least one space. The arrangement may be such that the gas collecting device defines a single space having portions adjacent the entire at least one outlet.

The container further comprises a mobile closure for the at least one opening and means for moving the closure between a first position in which the opening is closed (and preferably sealed) and at least one second position in which the opening is exposed. As mentioned above, the opening is preferably located beneath the at least one outlet for gaseous carrier medium and is preferably positioned and oriented in such a way that it permits evacuation of intercepted tobacco by gravity flow in response to movement of the closure to the at least one second position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
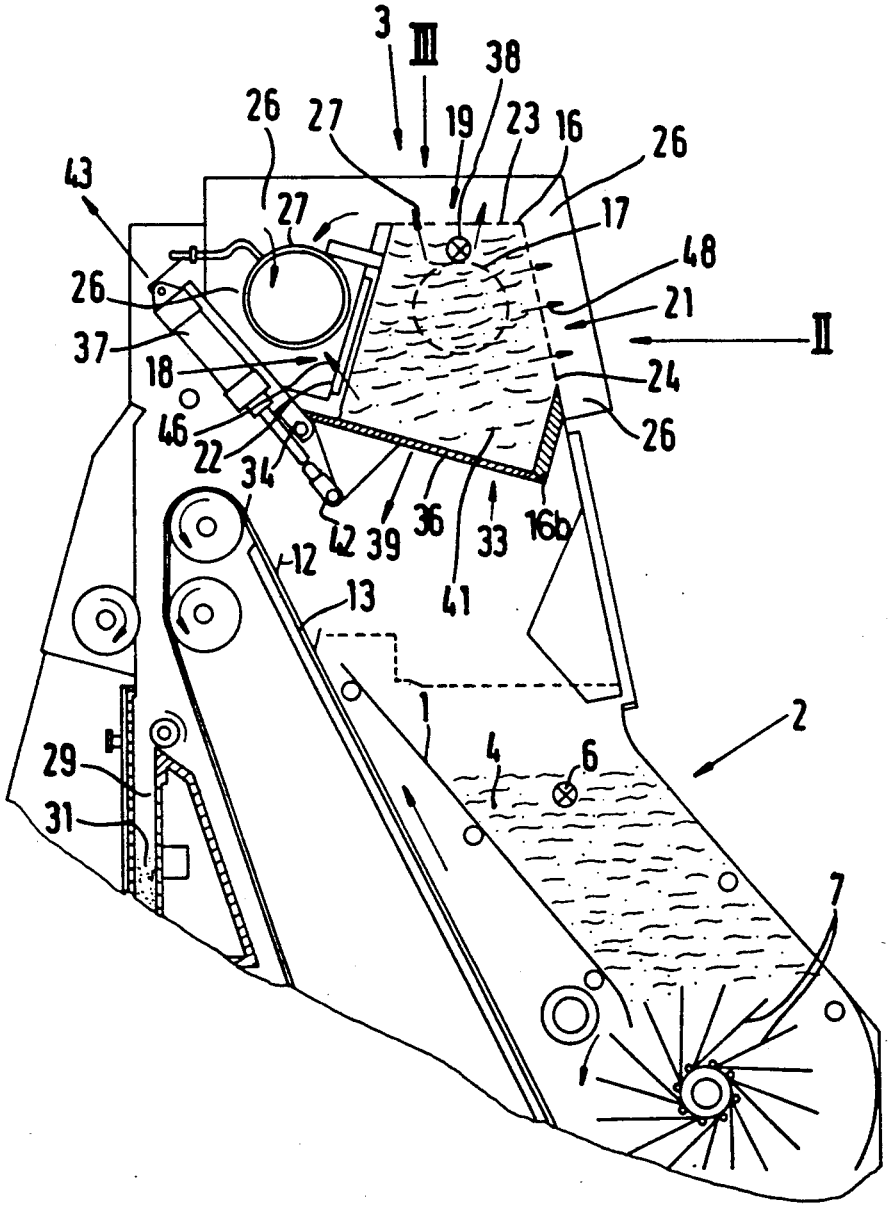
FIG. 1 is a fragmentary vertical sectional view of a distributor for use in a rod making machine and of an apparatus which embodies one form of the invention and serves to deliver tobacco particles to the magazine of the distributor.

FIG. 1 shows a portion of a distributor or hopper 2 forming part of a cigarette rod making machine of the type known as PROTOS which is made and sold by the assignee of the present application. The distributor 2 includes a magazine 1 which receives tobacco particles 41 (e.g., shredded tobacco ribs and/or shredded tobacco leaf laminae) from an apparatus 3 which is constructed and assembled and operates in accordance with one presently preferred embodiment of the invention. The non-illustrated portion of the distributor 2 can be constructed in a manner as described and shown in commonly owned U.S. Pat. No. 4,651,758 granted Mar. 24, 1987 to Kahrau. The cigarette rod making machine which receives a continuous stream of tobacco particles from the distributor can be constructed and assembled in a manner as described and shown, for example, in commonly owned U.S. Pat. No. 4,185,644 granted Jan. 29, 1980 to Heitmann et al. The disclosures of the patents to Kahrau and Heitmann et al. are incorporated herein by reference.

The apparatus 3 is designed to supply batches of tobacco particles 41 to the magazine 1 wherein the upper surface of the accumulated supply 4 should not descend below the level of a detector 6 (e.g., a photoelectronic detector) in order to ensure that the entraining elements 12 of an endless elevator conveyor 13 can supply tobacco particles into an upright gathering duct 29 at such a rate that the height of the column 31 of tobacco particles in the duct fluctuates very little or not at all. A rotary paddle wheel 7 is provided to supply tobacco particles from the magazine 1 toward the path of entraining elements 12 of the elevator conveyor 13. When the detector 6 is exposed above the upper surface of the supply 4 of tobacco particles 41 in the magazine 1, it transmits a signal which induces the apparatus 3 to dump a fresh batch of tobacco particles into the magazine.

As a rule, the paddle wheel 7 delivers tobacco particles from the supply 4 into a second magazine beneath the magazine 1 (refer to the patent to Kahrau), and the entraining elements 12 of the elevator conveyor 13 then draw tobacco particles directly from the second magazine. This ensures that the elevator conveyor 13 entrains tobacco particles which have been loosened on their way from the magazine 1 into the second magazine and thence into the range of the entraining elements 12.

The column 31 of tobacco particles in the duct 29 is converted into a carpet, the carpet is converted into a stream, the stream is equalized, and the equalized stream is compacted and draped into a web of wrapping material to form a continuous cigarette rod which is ready to be subdivided into plain cigarettes of unit length or multiple unit length.

The invention resides in the construction and mode of operation of the apparatus 3 which is carried by the frame of the distributor 2 at a level above the magazine 1 so that the latter can receive batches of tobacco particles 41 by gravity feed.

The illustrated apparatus 3 comprises a container 16 (e.g., an elongated sluice) which has an inlet 16*a* (FIG. 2) connected to the discharge end of a first pneumatic conveyor 17, and a composite outlet (at its sides 18, 19 and 21) for evacuation of a gaseous carrier medium (normally air and hereinafter referred to as air for short) from the interior of the container. The latter further comprises an opening 16*b* which is provided at a level beneath the outlet and is normally closed and sealed by a mobile closure 36. The conveyor 17 serves to deliver (when necessary) a stream of air which carries tobacco particles 41 (such as shredded tobacco ribs and/or shredded tobacco leaf laminae) from a shredding machine or any other suitable source. A shredding machine which can be used to supply tobacco particles to the intake end of the pneumatic conveyor 17 is disclosed, for example, in commonly owned U.S. Pat. No. 4,401,205 granted Aug. 30, 1983 to Komossa et al.

The illustrated container 16 has a quadrangular cross-sectional outline with four sides 18, 19, 21 and 33. The outlets in the sides 18, 19, 21 respectively contain tobacco intercepting devices 22, 23, 24 in the form of sieves, screens or filters (hereinafter called sieves) which are permeable to air and permit air to escape from the interior of the container 16 in three different directions (as indicated by the arrows 46, 47 and 48, respectively). The opening 16*b* is located at the fourth side 33 at a level below the outlets and screens 22, 23 and 24.

The illustrated container 16 can be replaced with a container having a triangular, pentagonal or other polygonal cross-sectional outline. Furthermore, at least a portion of the container can be rounded, and such container can be equipped with one or more arcuate sieves. All that counts is to ensure that the outlet or outlets of the container will permit escape or evacuation of air in several directions. This greatly reduces the likelihood of clogging of the sieves with tobacco and ensures more predictable delivery of tobacco particles 41 by way of the pneumatic conveyor 17. The sieves 22, 23, 24 are preferably detachable to permit periodic inspection, cleaning or replacement.

The sieve 22 is shown in FIG. 1 together with its frame. The frames of the sieves 23, 24 have been omitted in FIG. 1 for the sake of clarity.

The apparatus 3 further comprises an air collecting device 26 which is outwardly adjacent the outlets (i.e., outwardly adjacent the sieves 22, 23, 24) and defines a chamber or space for confinement of air which escapes through the interstices of the sieves in the directions indicated by arrows 46, 47 and 48. The outlet of the chamber or space in the air collecting device 26 is connected with the receiving end of a second pneumatic conveyor 27 which has a discharge end connected to a suction generating device (not shown), e.g., to the air intake of a blower or fan which supplies compressed air to the receiving end of the pneumatic conveyor 17.

The closure 36 for the opening 16*b* of the container 16 is pivotable about the pintle of a horizontal hinge 34. The means for moving the closure 36 between the closed position of FIG. 1 and at least one open position includes a fluid-operated motor 37 having a cylinder articulately connected to the frame of the distributor 2 and a reciprocable piston rod with a free lower end articulately connected (at 42) to a downwardly extending lug of the closure 36. The valve or valves which control the flow of a pressurized (gaseous or hydraulic) fluid into and from the cylinder of the motor 37 receive signals from the detector 6 in the magazine 1 of the distributor 2. The arrow 39 indicates the direction of pivotal movement of the closure 36 from the illustrated closed position toward an open position in which a batch of tobacco particles 41 is free to leave the interior of the container 16 by gravity to descend into the magazine 1. The detector 6 transmits a signal which initiates pivoting of the closure 36 from the position of FIG. 1 when the upper surface of the supply 4 of tobacco particles 41 in the magazine descends sufficiently to permit a beam of radiation issuing from the radiation source of the detector 6 to reach the photoelectronic signal generating transducer of the detector. Other types of detector means can be used with equal or similar advantage. The arrow 43 indicates the direction of movement of the piston (not shown) and the piston rod of the motor 37 in response to a signal from the detector 6.

The operation is as follows:

The closure 36 is normally maintained in the position of FIG. 1 in which the opening 16*b* is closed and sealed. The aforementioned blower or fan (or another suitable suction generating device) can be started in automatic response to closing of the opening 16*b* to thus initiate the flow of an air stream in the direction of arrow A (FIGS. 2 and 3), i.e., the pneumatic conveyor 17 delivers tobacco particles 41 into the interior of the container 16 and the air is free to leave the container through the sieves 22, 23, 24 to enter the conveyor 27 through the chamber or chambers of the collecting device 26. The sieves 22 to 24 intercept the tobacco particles 41 so that the supply of such particles in the container 16 grows and ultimately causes a second detector 38 (e.g., a photoelectronic detector) to arrest the blower or fan so that the conveyor 17 ceases to deliver tobacco particles by way of the inlet 16*a* of the container 16. The collecting device 26 can include a single chamber (this is actually shown in the drawing), or a discrete chamber outwardly adjacent each of the sieves 22, 23, 124. Such discrete chambers are then connected with the intake of the blower by the illustrated single second conveyor 27 or by discrete second conveyors.

An advantage of the illustrated collecting device 26 is that it can receive air which flows through all of the sieves and can return such air to the blower by way of a single second conveyor 27.

The container 16 confines a batch of tobacco particles 41, and such batch is free to descend into the magazine 1 as soon as the detector 6 transmits a signal denoting that the supply 4 of tobacco particles has been depleted to a predetermined minimum acceptable level. The motor 37 then pivots the closure 36 to the open position (arrow 39), and the batch is free to leave the container 16 on its way into the magazine 1.

The motor 37 can automatically return the closure 36 to the position of FIG. 1 after elapse of a preselected interval of time which suffices for dumping of a batch into the magazine 1. Alternatively, the detector 6 can transmit a signal to the motor 37 (to return the closure 36 to the position of FIG. 1) when it ascertains that the upper surface of the supply 4 has risen above the minimum acceptable level. Closing of the opening 16*b* can result in the generation of a signal which causes the blower to initiate renewed flow of an air stream in the direction of arrow A and renewed delivery of tobacco particles 41 into the container 16.

Figure 2:
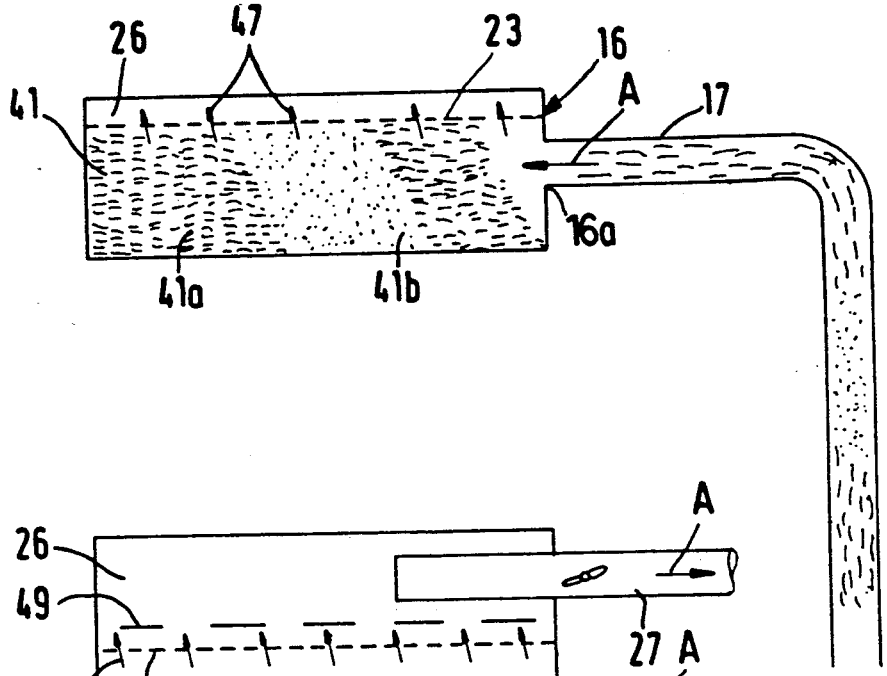
FIG. 2 is a smaller-scale side elevational view of the container of the improved apparatus, substantially as seen in the direction of arrow II in FIG. 1.

FIG. 2 shows that the conveyor 17 can deliver tobacco particles 41 including larger particles 41*a* and smaller particles 41*b*. The larger particles 41*a* normally include a certain percentage of smaller particles. A partial segregation of tobacco particles 41 in the container according to size is not undesirable because this simplifies further segregation which is normally carried out in the distributor of a rod making machine (reference may be had to the aforementioned U.S. Pat. No. 4,185,644 to Heitmann et al.).

Figure 3:
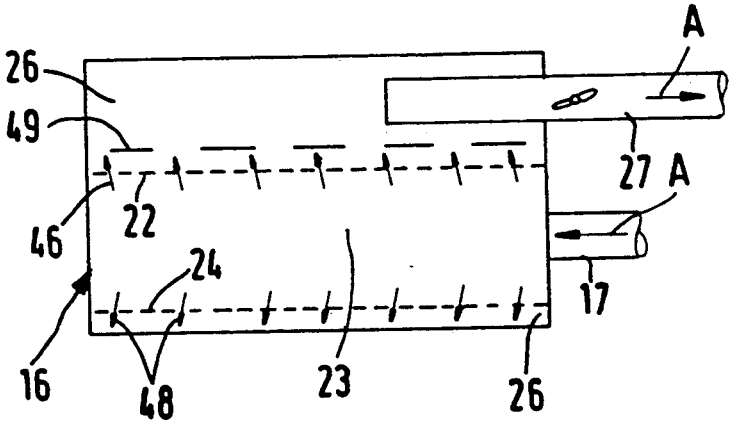
FIG. 3 is a smaller-scale plan view of the container, substantially as seen in the direction of arrow III in FIG. 1.

FIG. 3 shows that the pneumatic conveyors 17 and 27 can be disposed at one and the same end of the container 16. FIGS. 2 and 3 further show that the sieves 22, 23 and 24 are oriented to direct escaping air in three clearly different directions (arrows 46, 47 and 48, respectively). This ensures that the tobacco particles 41 in the container 16 exhibit a less pronounced tendency to clog the outlet for air than in heretofore known apparatus wherein the container is provided with an outlet which permits the outflow of air in a single direction. Such flow of air in a single direction results in rapid clogging of the sieve with tobacco particles so that the rate of evacuation of air (and hence the rate of delivery of tobacco particles into the container of a conventional apparatus) fluctuates within a wide range.

FIG. 3 further shows a flow restrictor 49 (e.g., in the form of a plate made of sheet metal or the like) which can be adjusted to select an optimum rate of air flow from the container 16 into the collecting device 26 and thence into the second conveyor 27.

The improved apparatus exhibits numerous important advantages. Thus, and as already mentioned above, the sieves 22, 23, 24 are much less likely to be rapidly clogged with tobacco particles than in a conventional apparatus with a single sieve and with the outflow of air in a single direction because each sieve of the improved apparatus 3 is traversed by a portion only of the total quantity of air which is supplied by the conveyor 17. Furthermore, the air stream which is supplied by the conveyor 17 carries out a much more uniform tobacco drying action than in a conventional apparatus. This, too, is attributable to subdivision of air in the container into several streams each of which flows in a different direction and through a different outlet or outlet portion of the container 16. It has been found that the relatively small tobacco particles 41*b* (such particles include so-called shorts and lightweight fragments of puffed tobacco) are much less likely to rapidly clog several discrete sieves each of which directs the escaping air in a different direction than in a conventional apparatus which discharges the gaseous carrier medium in a single direction. Still another advantage of the improved apparatus is that the tobacco particles 41 in the container 16 are not compacted into a dense cake or batch, again because the gaseous carrier medium is free to leave the container in at least two different directions.

The apparatus 3 can be modified in a number of additional ways without departing from the spirit of the invention. For example, the apparatus can be designed to deliver to the magazine 1 a continuous or practically continuous stream of tobacco particles. This would merely involve omission or opening of the closure 36 and the regulation of air flow into the conduit 17 so that the latter delivers tobacco at the same rate at which the elevator conveyor 13 delivers tobacco to the duct 29. Furthermore, the apparatus can employ one or more flat sieves and one or more arcuate sieves. Still further, the apparatus can be used in a cigar or cigarillo rod making machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A tobacco rod making machine comprising a distributor and an apparatus for separating shredded tobacco from at least one stream of a gaseous carrier medium, said apparatus comprising a tobacco collecting container having an inlet for the at least one stream and the tobacco therein, at least one outlet in communication with said inlet for evacuation of carrier medium from the container in a plurality of directions, gas-permeable tobacco intercepting means in said at least one outlet, and at least one opening for evacuation of collected tobacco from the container into said distributor.

2. The machine of claim 1, wherein said apparatus further comprising a pneumatic conveyor for the at least one stream of gaseous carrier medium, said conveyor having a discharge end connected with said inlet.

3. The machine of claim 2, wherein said container has a polygonal cross-sectional outline with at least three sides, said at least one outlet having portions in at least two of said sides and said at least one tobacco evacuating opening being provided in another of said sides.

4. The machine of claim 3, wherein said intercepting means comprises a sieve at each of said at least two sides.

5. The machine of claim 3, wherein said container has four sides and said outlet has portions in three of said sides.

6. The machine of claim 5, wherein the side which is provided with said at least one opening is located beneath said portions of said outlet.

7. The machine of claim 2, wherein said apparatus further comprises a gas collecting device defining at least one gas confining space which is outwardly adjacent the at least one outlet of said container to receive gaseous carrier medium which penetrates through said intercepting means, and a second pneumatic conveyor which evacuates carrier medium from said at least one space.

8. The machine of claim 7, wherein said collecting device defined a single space having portions adjacent the entire at least one outlet.

9. The machine of claim 9, wherein said at least one opening is located beneath said at least one outlet and is positioned to permit evacuation of intercepted tobacco by gravity flow in response to movement of said closure to said at least one second position.

10. The machine of claim 9, wherein said at least one opening is located beneath said at least one outlet and is positioned to permit evacuation of intercepted tobacco by gravity flow in response to movement of said closure to said at least one second position.

* * * * *